US008858206B2

(12) United States Patent
Richter et al.

(10) Patent No.: US 8,858,206 B2
(45) Date of Patent: Oct. 14, 2014

(54) PENDULUM-SLIDE CELL PUMP

(75) Inventors: Christian Richter, Steinbach (DE); Mark Tepler, Schleusingen (DE)

(73) Assignee: Mahle International GmbH (DE)

( * ) Notice: Subject to any disclaimer, the term of this patent is extended or adjusted under 35 U.S.C. 154(b) by 357 days.

(21) Appl. No.: 13/242,721

(22) Filed: Sep. 23, 2011

(65) Prior Publication Data

US 2012/0082582 A1 Apr. 5, 2012

(30) Foreign Application Priority Data

Sep. 28, 2010 (DE) ..... 10 2010 041 546

(51) Int. Cl.

| | |
|---|---|
| ***F03C 4/00*** | (2006.01) |
| ***F04C 2/00*** | (2006.01) |
| ***F04C 18/00*** | (2006.01) |
| ***F04C 2/332*** | (2006.01) |
| ***F04C 15/00*** | (2006.01) |
| *F04C 14/22* | (2006.01) |

(52) U.S. Cl.

CPC ..... *F04C 2/332* (2013.01); *F04C 14/223* (2013.01); *F04C 15/0061* (2013.01)

USPC ..... 418/173; 418/259; 418/268

(58) Field of Classification Search

USPC ..... 418/173, 259, 260, 266–268

See application file for complete search history.

(56) References Cited

U.S. PATENT DOCUMENTS

| | | | | |
|---|---|---|---|---|
| 4,758,141 | A | 7/1988 | Radermacher | |
| 5,190,447 | A * | 3/1993 | Schneider | 417/356 |
| 7,540,729 | B2 * | 6/2009 | Schneider | 418/173 |

FOREIGN PATENT DOCUMENTS

| | | | | |
|---|---|---|---|---|
| DE | 686009 | C | 12/1939 | |
| DE | 3021883 | A1 | 10/1981 | |
| DE | 3624532 | A1 | 2/1988 | |
| DE | 3630515 | A1 | 4/1988 | |
| DE | 19532703 | C1 | 11/1996 | |
| DE | 10132298 | A1 | 4/2002 | |
| GB | 2073323 | A | 10/1981 | |
| JP | 02169882 | A * | 6/1990 | 418/173 |

OTHER PUBLICATIONS

DE 19532703 C1, Beez Guenther et al., Pump or hydraulic motor with inner and outer rotors—Nov. 21, 1996—English Translation.*
English abstract provied for DE-19532703.
English abstract provided for DE-10132298.
English translation for DE-3630515.

* cited by examiner

*Primary Examiner* — Theresa Trieu
(74) *Attorney, Agent, or Firm* — Rader, Fishman & Grauer PLLC

(57) ABSTRACT

A pendulum-slide cell pump may include a rotationally mounted inner rotor connected via pendulum-slides with an outer rotor and wherein the outer rotor may be configured to transfer rotational movement of the outer rotor to the inner rotor via the pendulum-slides.

12 Claims, 1 Drawing Sheet

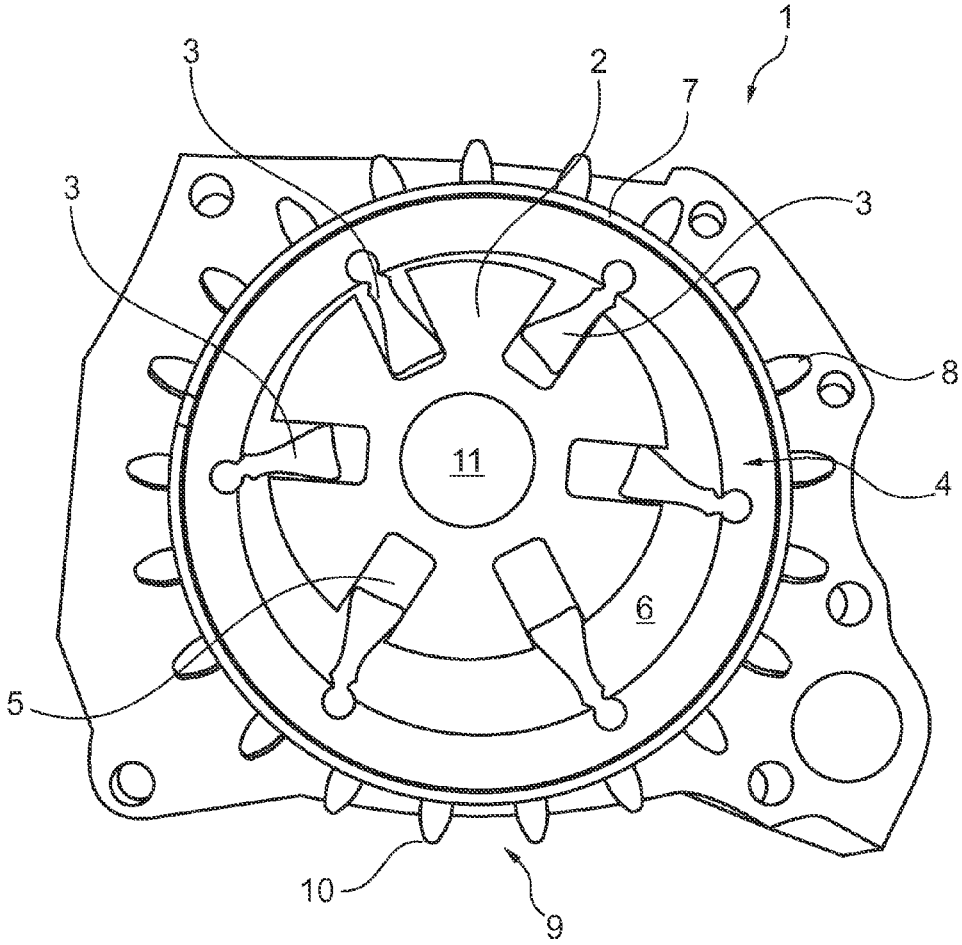
1
2
3
3
3
7
8
4
11
6
5
10
9

PENDULUM-SLIDE CELL PUMP

CROSS-REFERENCES TO RELATED APPLICATION

This application claims priority to German patent application DE 10 2010 041 546.4 filed on Sep. 28, 2010, which is hereby incorporated by reference in its entirety.

TECHNICAL FIELD

The present invention relates to a pendulum-slide cell pump, in particular for supplying an internal combustion engine with lubricant, for example with oil.

BACKGROUND

The use of quantity-controlled pendulum-slide cell pumps in internal combustion engines has been prior art for a long time, in order for example to be able to easily adapt a delivery quantity and a pressure to the requirement of the internal combustion engine. Such an adaptation mostly takes place by the impingement of a slide inside the pendulum-slide cell pump with an oil pressure originating from a main oil passage of the internal combustion engine.

From DE 195 32 703 C1 a generic pendulum-slide cell pump is known for the supply of an internal combustion engine with lubricant, in particular with oil, with an inner rotor and a displaceable outer rotor, co-rotating via pendulum carriers. For rotary driving from the inner rotor to the eccentrically displaceable outer rotor, always only one pendulum carrier is in sliding contact with its carrier head, carrier foot and only one sliding flank. The outer rotor is displaced to control a delivery rate.

Further pendulum-slide cell pumps are known for example from DE 36 30 515 A1, from DE 36 24 532 A1 and from DE 30 21 883 A1.

SUMMARY

The present invention is concerned with the problem of providing an improved or at least an alternative embodiment for a pendulum-slide cell pump of the generic type, which is distinguished in particular by a different drive concept.

This problem is solved according to the invention by the subject matter of the claims.

The present invention is based on the general idea of driving a pendulum-slide cell pump, which is constructed for example for the supply of an internal combustion engine with lubricant, and has a rotationally mounted inner rotor and an outer rotor in connection therewith via pendulum-slides, not only as hitherto on the inner rotor, but also according to the invention on the outer rotor, so that the outer rotor is driven and transfers the rotational movement to the inner rotor via the pendulum-slides. The mode of operation of the pendulum-slide cell pump does not differ here from pendulum-slide cell pumps known hitherto, except for the drive concept, so that the pendulum-slide cell pump according to the invention also has all the advantages of pendulum-slide cell pumps known hitherto. By the drive of the pendulum-slide cell pump according to the invention on the outer rotor, however, a totally new kind of drive concept is realized, which offers a multiplicity of advantages which are not yet foreseeable at the time of the invention.

In an advantageous further development of the solution according to the invention, the outer rotor is connected in a torque-proof manner with a hollow wheel, wherein the hollow wheel can be constructed for example as a chain wheel, as a toothed wheel, as a belt wheel or as a friction wheel. This list already suggests that in addition to conventional chains, belts of any kind can also be used to drive the outer rotor and hence to drive the pendulum-slide cell pump. The drive concept corresponds here for example to a V-belt, as is already diversely used in motor vehicles.

Further important features and advantages of the invention will emerge from the sub-claims, from the drawings and from the associated description of the figures with the aid of the drawings.

It shall be understood that the features mentioned above and to be further explained below are able to be used not only in the respectively indicated combination, but also in other combinations or in isolation, without departing from the scope of the present invention.

BRIEF DESCRIPTION OF THE DRAWING

A preferred example embodiment of the invention is illustrated in the drawings and is explained in further detail in the following description.

The single FIG. 1 shows a pendulum-slide cell pump according to the invention.

DETAILED DESCRIPTION

In accordance with FIG. 1, a pendulum-slide cell pump 1 according to the invention for the supply of an internal combustion engine with lubricant, in particular with oil, has a rotationally mounted inner rotor 2, which is connected via pendulum-slides 3 with an outer rotor 4. The pendulum-slides 3 are mounted pivotably here, both on the inner rotor 2 and also on the outer rotor 4. The pendulum-slides 3 are mounted so as to be radially displaceable in substantially radial slits 5 in the inner rotor 2, wherein the inner rotor 2 together with the pendulum-slides 3 and the outer rotor 4 delimits chambers 6, which according to the rotational position of the rotors 2, 4 serve as suction chambers or respectively as pressure chambers for the conveying of fluid. According to the invention, in the illustrated pendulum-slide cell pump 1, the outer rotor 4 is driven and transfers a rotational movement via the pendulum-slides 3 to the inner rotor 2. This is contrary to a drive concept in conventional pendulum-slide cell pumps 1, in which usually the inner rotor 2 is driven and transfers its rotational movement via the pendulum-sliders 3 to the outer rotor 4. The outer rotor 4 can be mounted here in a bearing bush 7 and can be connected in a torque-proof manner with a hollow wheel 8. The torque-proof connection between the outer rotor 4 and the hollow wheel 8 can take place for example in a force-fitting or a form-fitting manner.

In the embodiment of the pendulum-slide cell pump 1 according to the invention, shown in accordance with FIG. 1, the hollow wheel 8 is constructed as a toothed wheel and consequently has an outer toothed ring 9. Of course, a construction of the hollow wheel 8 as, for example, a chain wheel, a belt wheel or a friction wheel is also conceivable, as is known for example from V-belt connections in conventional internal combustion engines. The outer toothed ring 9 has individual teeth 10 here, which in particular have rounded tooth flanks, in order to thereby make possible a quiet roll motion.

Looking further at FIG. 1, it can be seen that the pendulum-slide cell pump 1 has six pendulum-slides 3, wherein of course also different number of pendulum-slides 3 is also to be comprised by the invention. Furthermore, it is also conceivable that a delivery rate of the pendulum-slide cell pump 1 is brought about by a rotational speed of the outer rotor 4 and/or by a slide which is not shown and is prestressed for example by a spring and is adjustable, by the inner rotor 2 and the outer rotor 4 being received, and which regulates or respectively reduces the delivery rate of the pendulum-slide cell pump 1 via a displacement of the inner rotor 2 relative to the outer rotor 4 or vice versa. Generally, the hollow wheel 8, which is constructed as a toothed wheel, can of course also mesh directly with a rotor of a drive arrangement which is not shown, and can be driven in this way. With the pendulum-slide cell pump 1 according to the invention it is in any case possible to realize an entirely different drive concept compared with hitherto known pendulum-slide cell pumps or respectively vane cell pumps, and thereby potentially to achieve advantages, in particular with regard to the utilization of the installation space. In the pendulum-slide cell pump 1 according to the invention, the inner rotor 2 is arranged in a torque-free manner on a shaft 11.

The invention claimed is:

1. A pendulum-slide cell pump comprising:

a rotationally mounted inner rotor connected via pendulum-slides with an outer rotor; and a hollow wheel with which the outer rotor is connected, the hollow wheel being a toothed wheel having an outer toothed ring;

wherein the outer rotor is configured to transfer rotational movement of the outer rotor to the inner rotor via the pendulum-slides.

2. The pendulum-slide cell pump according to claim 1, wherein each of the pendulum-slides is pivotably mounted on each of the inner rotor and outer rotor.

3. The pendulum-slide cell pump according to claim 2, wherein the pendulum-slides include six pendulum-slides.

4. The pendulum-slide cell pump according to claim 2, wherein the inner rotor and the outer rotor are received in an adjustable slide configured to regulate a delivery rate of the pendulum-slide cell pump.

5. The pendulum-slide cell pump according to claim 2, wherein the pendulum-slides are mounted in radial slits in the inner rotor.

6. The pendulum-slide cell pump according to claim 1, wherein the outer rotor is connected in at least one of a force-fitting and form-fitting manner with the hollow wheel.

7. The pendulum-slide cell pump according to claim 6, wherein the pendulum-slides include six pendulum-slides.

8. The pendulum-slide cell pump according to claim 1, wherein the pendulum-slides include six pendulum-slides.

9. The pendulum-slide cell pump according to claim 1, wherein the inner rotor and the outer rotor are received in an adjustable slide configured to regulate a delivery rate of the pendulum-slide cell pump.

10. The pendulum-slide cell pump according to claim 1, wherein the pendulum-slides are mounted in radial slits in the inner rotor.

11. The pendulum-slide cell pump according to claim 1, wherein the pendulum-slides include six pendulum-slides.

12. A pendulum-slide cell pump comprising:

a rotationally mounted inner rotor connected via six pendulum-slides with an outer rotor;

wherein the outer rotor is configured to transfer rotational movement of the outer rotor to the inner rotor via the pendulum-slides;

wherein the outer rotor is connected in a torque-proof manner with a hollow wheel; and wherein the hollow wheel is a toothed wheel having an outer toothed ring.

* * * * *